US005647445A

United States Patent [19]

Puchala

[11] Patent Number: 5,647,445

[45] Date of Patent: Jul. 15, 1997

[54] DOUBLE PISTON IN-THE-HOLE HYDRAULIC HAMMER DRILL

[75] Inventor: Ryszard J. Puchala, Gloucester, Canada

[73] Assignee: National Research Council of Canada, Ottawa, Canada

[21] Appl. No.: 561,819

[22] Filed: Nov. 22, 1995

[51] Int. Cl.[6] ..... E21B 4/14

[52] U.S. Cl. ..... 175/296; 173/132

[58] Field of Search ..... 175/296, 297; 173/101, 132

[56] References Cited

U.S. PATENT DOCUMENTS 2,917,025 12/1959 Dulaney ..... 173/132 X
3,602,317 8/1971 Scroggins ..... 173/132 X

FOREIGN PATENT DOCUMENTS 9423171 10/1994 WIPO .

*Primary Examiner*—David J. Bagnell

[57] ABSTRACT

An in-the-hole hydraulic hammer drill of the type having an inlet passageway for fluid and connectible to a drill string providing a source of pressurized fluid, and having pistons capable of providing downwardly directed impacts onto anvils solidly connectible to a drill bit, and having valves operated automatically by movement of the pistons to provide a continuous cycle of operation. The pistons include an upper piston and a lower piston, each capable of impacting respective upper and lower anvils solid with the drill bit, and the valves means include an inlet valve situated at the junction of the lower end of the upper piston and the upper end of the lower piston and closable by the coming together of the upper and lower pistons, and an outlet valve at the lower end of the lower piston and having a valve member operated by the lower piston. The valves and pistons are arranged so that when the outlet valve is closed and the inlet valve is open fluid pressure causes both pistons to rise, and so that when the inlet valve is closed and the outlet valve is open both pistons descend together until the upper piston is halted in its movement by impacting the upper anvil. The lower piston continues to descend until impacting the lower anvil means. The impacts from the two pistons are close together in time.

11 Claims, 7 Drawing Sheets

DOUBLE PISTON IN-THE-HOLE HYDRAULIC HAMMER DRILL

BACKGROUND OF THE INVENTION

1. Field of the Invention

This invention relates to a hammer drill for drilling through rock formations, having an improved hammer piston and valve arrangement which allows more effective penetration of hard rocks.

2. Prior Art

It is known to provide a hammer drill with a piston operated by liquid, usually water, supplied to the top of a drill string, and which is capable of providing downwardly directed impacts on an anvil forming part of, or being connectible to, a drill bit. Valves are provided to allow continuous cycling of the piston to give repeated impacts.

In such prior hydraulic hammers, when the piston is abruptly stopped by hitting the anvil, the liquid pressure suddenly increases to a peak, putting strain on the drilling string. It has been proposed in accordance with International Patent Application No, WO 94/23171 (Mclnnes) to reduce these strains by having two pistons which reciprocate 180° out of phase with each other. This doubles the frequency of the impacts and reduces the pressure peaks during drilling, but results in impacts which are not as forceful as would be obtained with a single piston.

SUMMARY OF THE INVENTION

The present invention provides a hydraulic hammer which, like that of Mclnnes, has two pistons and which provides two impacts in each cycle. However, instead of the pistons operating 180° out of phase with each other, the pistons are in phase over much of their cycles, and are arranged to provide impacts in similar parts of their cycles and which are very close together in time. The impacts are close enough together to act like an impact of increased amplitude and/or duration, enhancing bit penetration in hard rocks, while at the same time limiting the pressure peaks in the pressurized liquid.

Specifically, the present invention provides an in-the-hole hydraulic hammer drill of the type having an inlet passageway for liquid and connectible to a drill string providing a source of pressurized liquid, and having piston means capable of providing downwardly directed impacts onto anvil means solid with a drill bit, (i.e. forming part of, or solidly connectible to, the drill bit), and valve means operated automatically by movement of the piston means and/or by liquid pressure to provide a continuous cycle of operation including a continuous series of impacts. The hammer drill is characterized in that the piston means includes an upper piston and a lower piston, each having a lower portion of larger diameter than an upper portion, and each capable of impacting respective upper and lower anvil means. The valve means includes an inlet valve situated adjacent the lower end of the upper piston and the upper end of the lower piston and closable by the coming together of the pistons, and an outlet valve at the lower end of the lower piston the valve member of which is opened by the lower piston when approaching its upper position and closed by the lower piston when approaching its lower position. The valves are arranged so that when the outlet valve is closed and the inlet valve is open fluid pressure is applied to both ends of the pistons which causes these to rise. Towards the top of their stroke the pistons open the outlet valve and close the inlet valve, whereupon pressure on the upper end of the upper piston causes the pistons to descend together until the upper piston is halted in its movement by impacting the upper anvil means, while the lower piston continues to descend a short distance before impacting the lower anvil means, This final stage of movement closes the outlet valve and opens the inlet valve to repeat the cycle.

Preferably, the lower piston is longer and heavier than the upper piston. The inlet valve is constituted by valve parts carried by the lower end of the upper piston and by the upper end of the lower piston. The outlet valve member is adapted to be operated by means adjacent the lower end of the lower piston.

The hammer drill may be made suitable for drilling both small (less than 4 inch) or large (greater than 4 inch) diameter holes.

BRIEF DESCRIPTION OF THE DRAWINGS

A preferred embodiment of the invention will now be described by way of example with reference to the accompanying drawings, in which.

DETAILED DESCRIPTION

Figure 1:
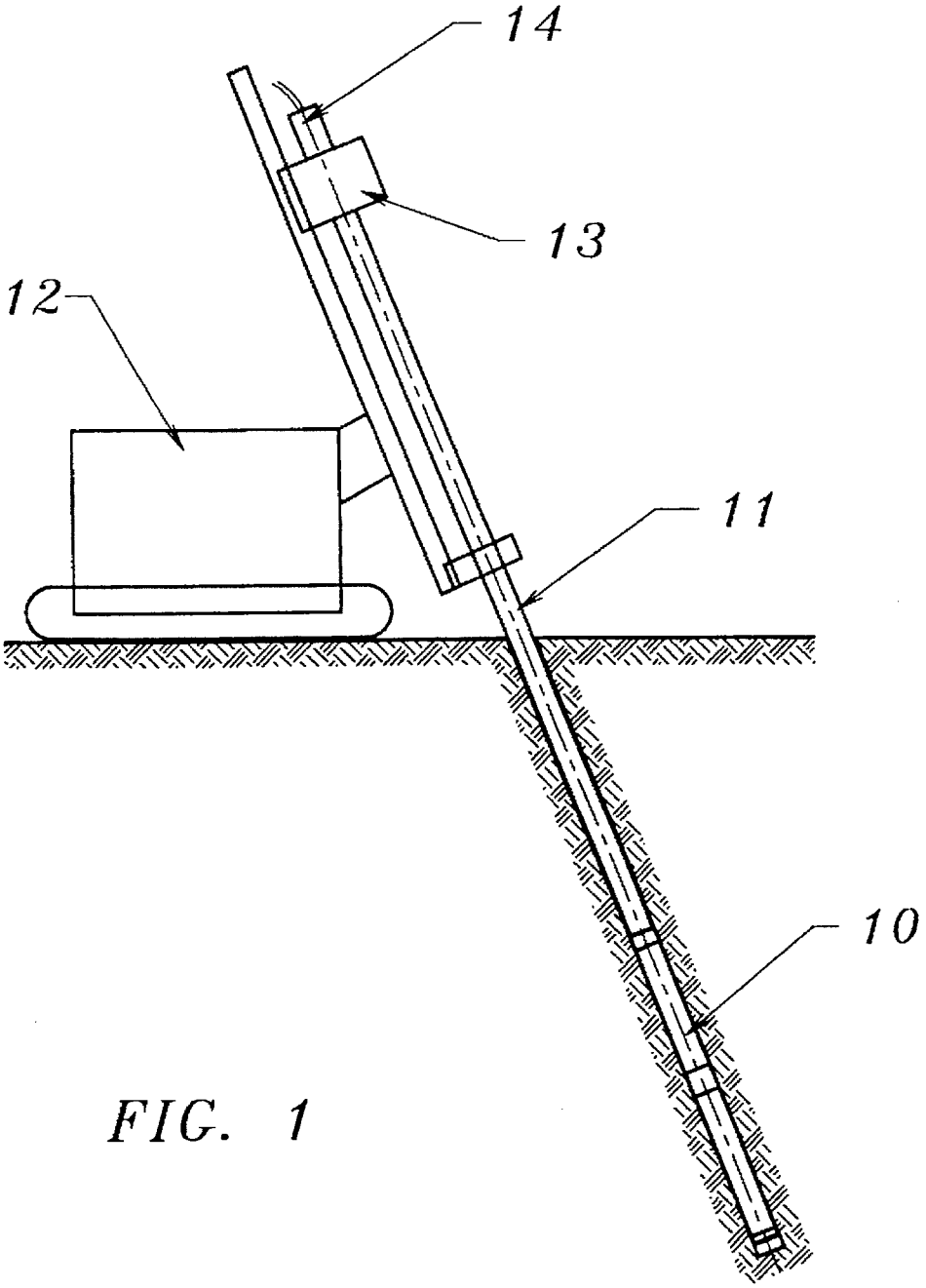
FIG. 1 shows a diagrammatic view of a drill rig using a hammer drill of this invention.
Figure 2:
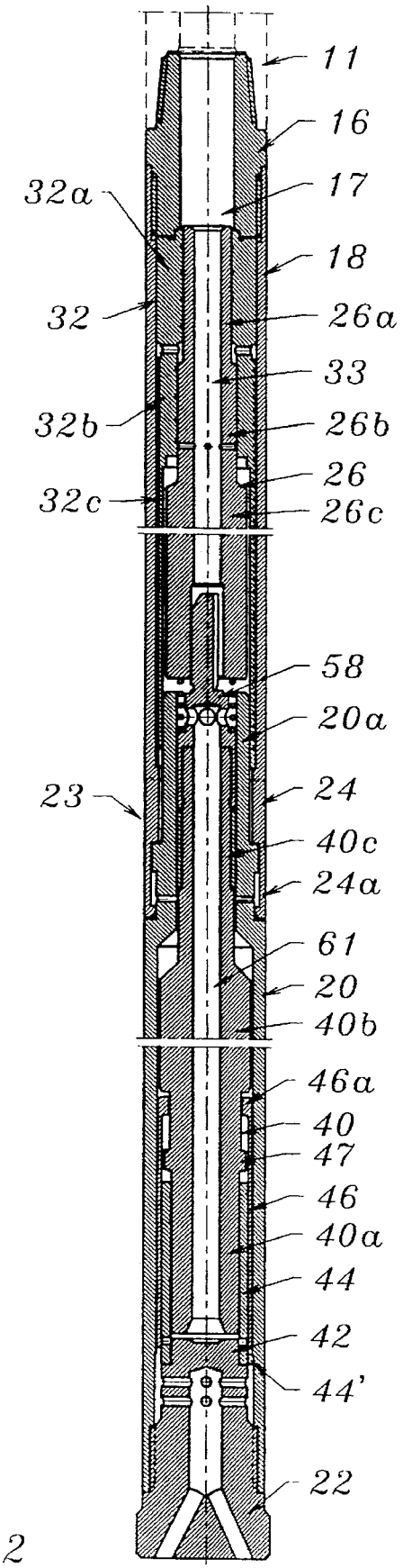
FIG. 2 shows a longitudinal section of the hammer drill.
Figure 3A:
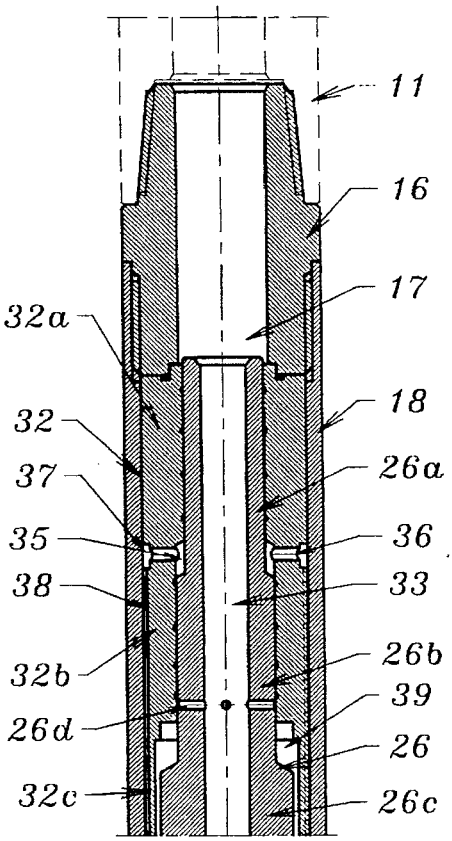
FIGS. 3*a*, 3*b*, and 3*c* show enlarged views of the upper, central, and lower portions respectively of the hammer drill shown in FIG. 2, also in longitudinal section.
Figure 3B:
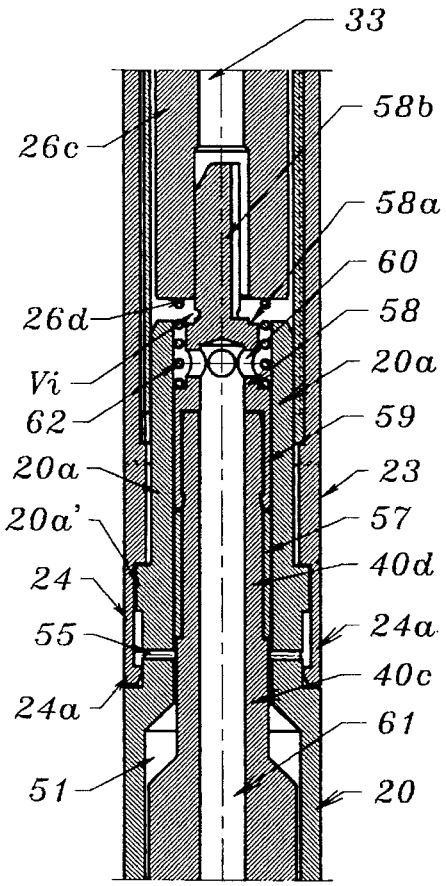
Figure 3C:
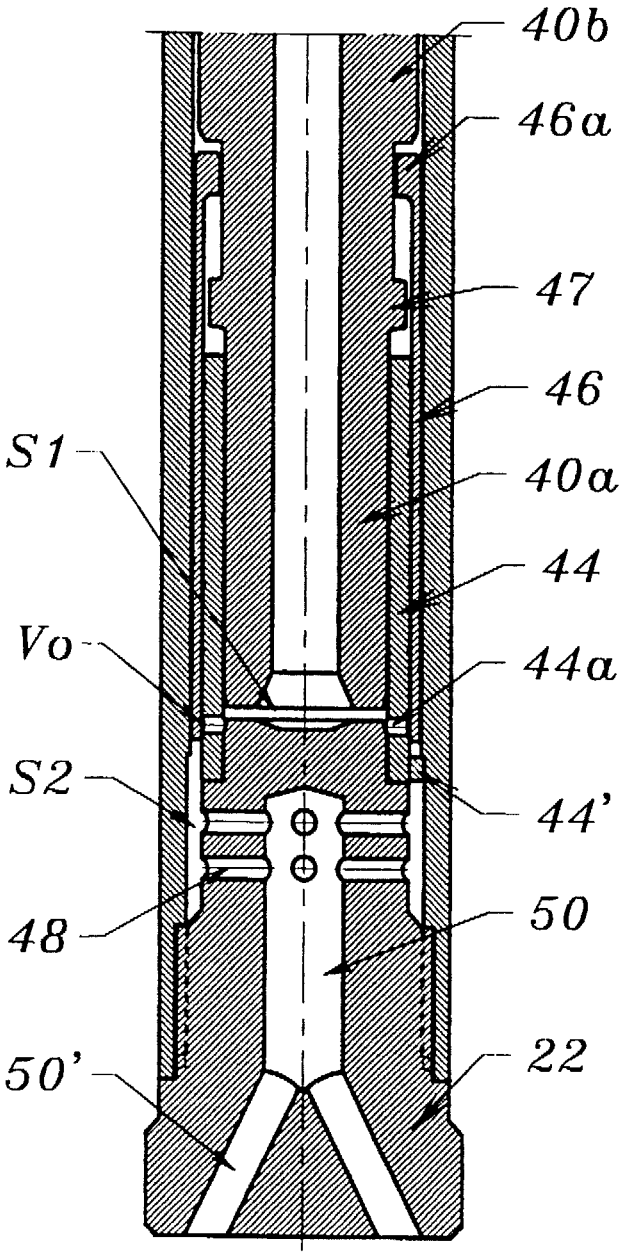

The hydraulic hammer drill 10 of this invention is shown in FIG. 1 installed at the lower end of drill string 11. The top end of the drill string is held by a drill rig 12 by conventional means including a rotating drive 13 and a water swivel 14 which provide the torque for the drill string and pressurized water or other hydraulic fluid.

Referring to FIGS. 2, 3*a*, 3*b* and 3*c*, the upper end of the hammer drill 10 is connected to the drill string 11 by a coupling 16 having a central passageway 17, the lower part of which coupling is fixed to the upper end of a cylindrical upper housing 18 which encloses almost half of the length of the hammer drill. Most of the lower half of the hammer drill is enclosed by a generally cylindrical shell 20, having the same external diameter as housing 18, and which has its lower end solidly connected to a replaceable drill bit 22.

Figure 4:
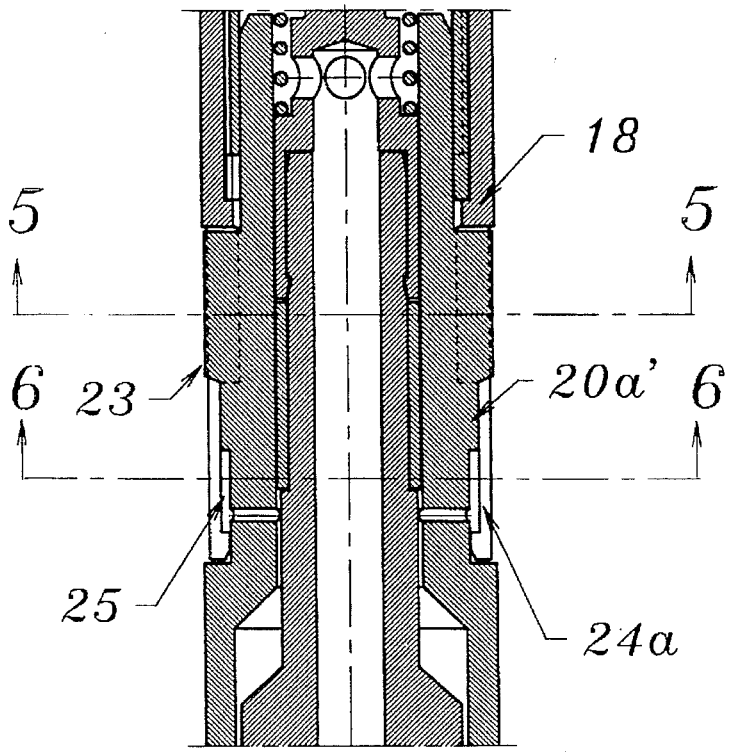
FIG. 4 shows a longitudinal section of the center of the hammer drill, similar to FIG. 3*b* but taken in a different diametral plane.
Figure 5:
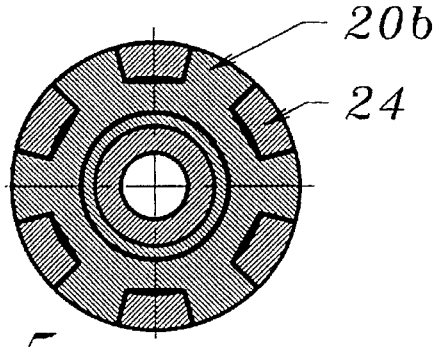
FIG. 5 is a cross-section on lines 5—5 of FIG. 4.
Figure 6:
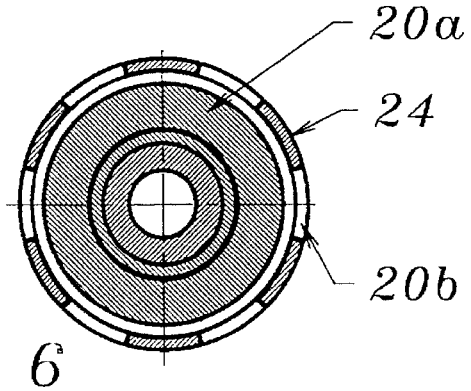
FIG. 6 is a cross-section on lines 6—6 of FIG. 4.

Shell 20 has an upper portion 20*a* of reduced diameter extending partly within the lower end of upper housing 18, and which is connected to the upper housing by a spline coupling 23 which transmits torque while allowing some longitudinal movement of the shell relative to the upper housing. As best seen in FIGS. 4–6, coupling 23 includes outer spline parts in the form of fingers 24 extending from the housing 18, slidably mating with splines 20*b* projecting from portion 20*a*, fingers 24 ending in flexible claws 24*a* capable of being snapped over an enlarged collar part 20*a*' of portion 20*a*. The internal configuration of members 24 provide internal space 25 which allows some longitudinal movement of the shell 20 relative to housing 18. The upper part of coupling 23 is engaged on the whole length of splines 20*b* during the drilling. This coupling minimizes the transmission of shock waves, produced by the hammer impacts, to the housing 18, and the movement it provides also allows regulation of an inlet valve, as will be described.

The upper end 20*c* of the shell portion 20*a* serves as an upper anvil part for receiving impacts from the lower end of an upper hammer piston 26 movable within the upper housing. This upper piston has a small diameter upper portion 26*a* slidable in an upper cylinder portion provided in an upper, small diameter portion 32*a* of a sleeve member 32 located within the upper end of housing 18; has a central, intermediate diameter portion 26*b* slidable in a correspondingly sized intermediate diameter cylindrical portion 32*b* of sleeve member 32, and a lower portion 26*c* of larger diameter which is spaced within lower, thin-walled portion 32*c* of sleeve member 32. The upper piston has a central passageway 33 extending along its length and freely communicating with passageway 17. The piston part 26*b* has several holes 26*d* capable of connecting central passage 33 with space 39 in the lowest position of the piston 26.

At the junction of the small and intermediate diameter portions 32*a* and 32*b* of the sleeve member 32 a cavity 35 surrounds the upper piston, and this communicates with radial ports 36 in the sleeve member walls. These ports lead to an outer recess 37 of the sleeve member 32, which recess communicates with a passages 38 formed in the outer surfaces of sleeve portions 32*b* and 32*c*. The combination of this cavity and the associated spaces provide a hydraulic cushion for the upper piston at the upper end of its stroke.

Since both the small diameter upper portion 26*a* and the intermediate diameter portion 26*b* of the upper cylinder slide in correspondingly sized cylindrical portions 32*a* and 32*b* of sleeve 32, when both ends of the piston are provided with fluid at similar working pressure, which may for example be from 1,000 to 3,000 psi, the piston will rise.

The shell 20 contains a lower hammer piston 40, the lower end of which impacts a lower anvil 42 at the upper end of bit 22. A recess surrounding the anvil 42 holds the lower end of a sleeve bushing 44 which slidably receives a lower end portion 40*a* of the lower piston; bushing 44 fits on the anvil part where it is held by engagement of lug 44' with a land inside shell 20 so as not to move with piston movements. The bushing 44 has several holes 44*a* in its lower end adjacent the top of anvil 42. The holes 44*a* are arranged to be covered and closed by the lower end of a sleeve type valve member 46 slidable between the bushing 44 and the inside of the shell 20, and the upper end portion 46*a* of this valve member can be divided into flexible fingers arranged to snap over a collar 47 surrounding the lower cylinder portion 40*a*, and which engages the end portion 46*a* as the piston nears the top of its stroke. The upper end portion 46*a* is engaged by an enlarged central part 40*b* of the lower piston as this nears the bottom of its stroke, and thus cooperates with the lower piston to operate the valve member 46 with lost motion represented by the space between the collar 47 and piston portion 40*b*. The holes 44*a* allow fluid to pass from the space S1 at the lower end of the piston 40 to the space S2 communicating with ports 48 of the anvil member when the valve member 46 is lifted to uncover these holes. When the piston has raised the valve member, fluid can flow through ports 48 and into a central passageway 50 and outlet ports 50' in the bit 22. Holes 44*a* and valve member 46 thus constitute an outlet valve indicated generally as Vo.

The lower piston 40 is longer and heavier than the upper piston 26, and the enlarged central portion 40*b*, which is spaced within the shell 20, provides a large mass. The upper end portion 40*c* of this lower piston is of smaller diameter than lower portion 40*a* and this is slidable within the extension 20*a* of the shell 20. A guide bushing 57 is provided surrounding a reduced diameter portion 40*d* of the upper end of the upper piston portion. Above these the top end of the upper piston portion fits within a cylindrical recess in the lower end of a valve member 58, this member being attached to the lower piston by flexible snap wings 59. The valve member has a central portion with sidewalls spaced from the inner surface of shell extension 20*a*, these sidewalls having ports 60 leading to a central cavity which in turn communicates with a central passageway 61 in the lower piston 40. The valve member 58 also has a valve seat 58*a* surrounding a guide member 58*b* slidable within the upper piston passageway 33, this member being shaped to provide channels so as not to prevent flow of fluid in this passageway. The valve seat 58*a* cooperates with matching surfaces 26*d* at the lower end of the upper piston to provide an inlet valve indicated generally as Vi, which, when open, allows fluid to flow from the upper piston passageway 33 into the lower piston passageway 61. A compression spring 62 between the valve member 58 and the upper piston cushions the closing of the inlet valve, and, in combination with hydraulic action of holes 26*d*, prevents any jamming of the pistons.

Shell portion 20*a* provides an upper cylindrical portion for bushing 57 which acts as part of the lower piston; since lower piston portion 40*a*, slidable in sleeve bushing 44, is of larger diameter than bushing 57, when both ends of the piston are subjected to similar working pressures derived from the same source, the piston will rise.

For both pistons provision is made for venting fluid from the annular area of the piston. In the case of the upper piston, this is done by ports 36, recess 37 and passageways 38. In the case of the lower piston the fluid is vented from space 51 via ports 55 at the junction of shell parts 20 and 20*a*, and then outwardly between the splines on parts 23 and 24, keeping these splines free of debris.

OPERATION

Figure 7A:
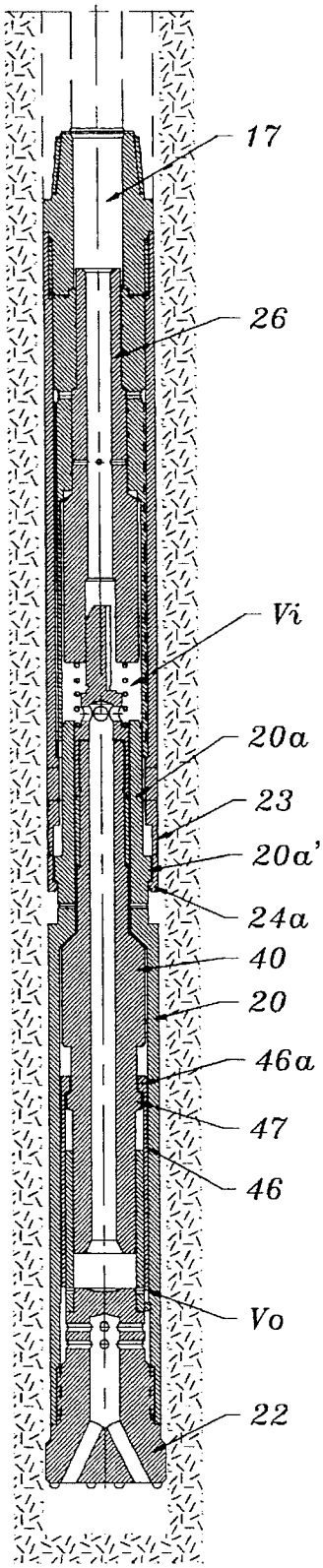
FIGS. 7*a* and 7*b* show longitudinal views of the drill, respectively in flushing and drilling modes.

FIG. 7*a* shows the position of the hammer drill parts as it is being lowered into part of a bore hole which has already been cut. As shown, the shell 20 is at maximum extension with shell collar 20*a'* held suspended by claws 24*a* of coupling 23. With the shell 20 in this position, the pistons remain apart and the inlet valve Vi remains open. Also, the collar part 47 of the lower piston holds the valve member 46 raised and the outlet valve open. Thus fluid entering the passageway 17 passes through the drill and leaves via the drilling bit.

Figure 7B:
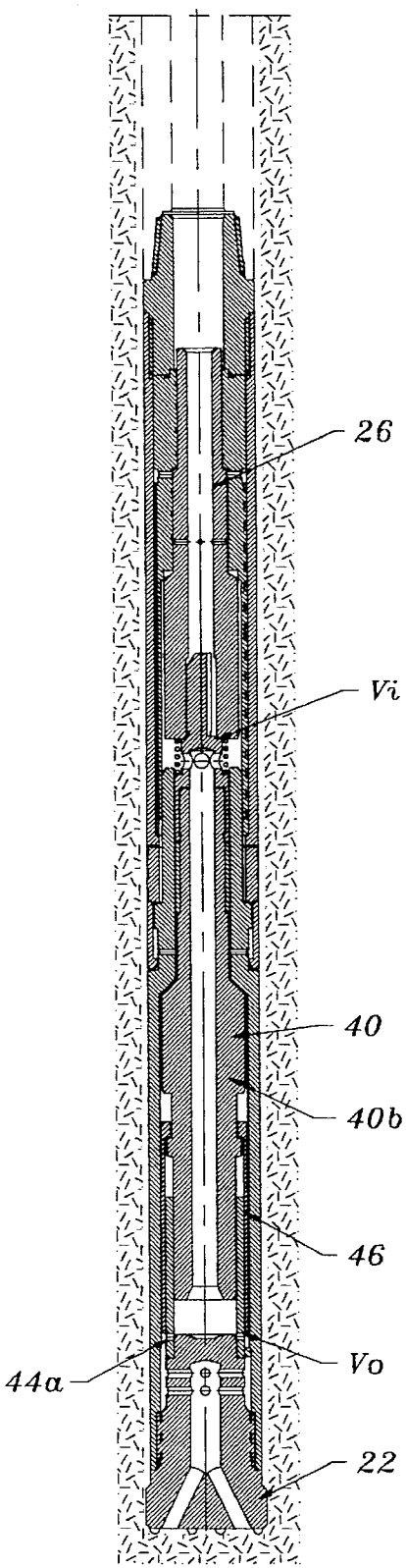

When resistance is encountered in the bore, the upper housing 18 moves down relative to the shell 20, as shown in FIG. 7*b*. Further downwards movement causes the enlarged portion 40*b* of the lower piston to strike the top of valve member 46, which then moves down until it covers ports 44*a* and thus closes the outlet valve. Assuming the passageway 17 is supplied with fluid at suitable volume and pressure, a continuous cycle of operations then occurs automatically, as shown in FIGS. 8*a* through 8*d*. *Referring to these drawings:*

8*a*) Pistons upward motion

At this stage the inlet valve Vi is open, since the two pistons are separated, and the outlet valve Vo is closed. Pressurized fluid passing down the passageways 17, 33 and 61 thus fills the spaces above and below both pistons, and causes both pistons to rise. However, since the inertia of the upper piston 26 is smaller than that of the lower piston 40, the upper piston accelerates faster than the lower piston and maintains a gap between these pistons in this stage, i.e. the inlet valve Vi remains open. Pressure in space 51 acting on part 46*a* holds the outlet valve Vo closed. The fluid in cavity 35 is drained outside the hammer through the ports 36 and passageway 38, and fluid in space 51 is drained through ports 55, and fluid from both sources exits between the splines of coupling 23.

Figures 8A, 8B, 8C, 8D:
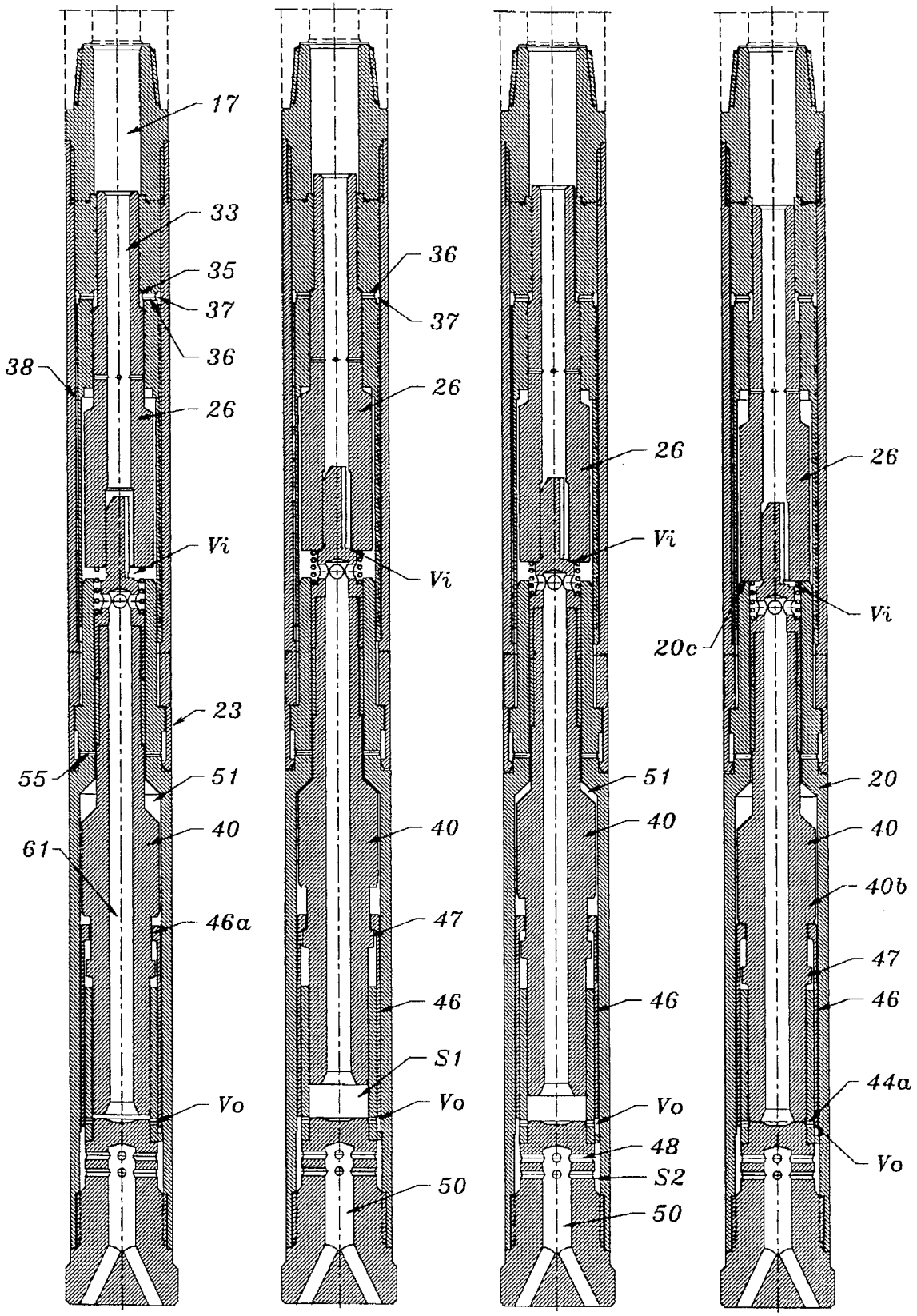
FIGS. 8*a*, 8*b*, 8*c*, and 8*d* are similar sectional views of the same hammer drill in drilling mode, showing the sequence of movements of the hammers and valves.

FIG. 8*b*) Pistons reverse upward movement

The upper piston 26 is slowed in the upper position of its upward stroke and eventually stopped by the hydraulic cushion in the cavity 35 induced by the lower portion of this piston covering the ports 36. The lower piston 40, in the later stage of its upward motion, lifts the valve member 46, opening the outlet valve so that fluid flows from space S1 to the passage 50 in the bit. Due to its inertia the lower piston continues to rise, closing the inlet valve Vi by contact between the lower surface 26*c* of the upper piston and the valve seat 58*a*. This closing of the inlet valve decelerates the column of fluid and produces compression waves, i.e. a water hammer effect. This dynamic hydraulic force acting on the pistons combined with the dynamic force induced during the piston collision or impact decelerates the lower piston and causes both pistons to reverse to a downward motion.

FIG. 8*c*) Pistons downward motion

The outlet valve Vo is now open and the inlet valve Vi is closed. Thus the top area of the upper piston is exposed to fluid pressure, which drives the both pistons in the downward direction. In space S1 the pistons encounter low hydraulic resistances due to the open flow of the fluid from this space through the outlet valve Vo, ports 48, and the central passage 50 to the exhaust at the bottom of the bit. The pressure in the space 51 is lower than the pressure in the space S2 due to the downward movement of the lower piston; this holds the outlet valve member 46 up so that this valve remains open.

FIG. 8*d*) Pistons reverse downward motion

In the latter stage of downward motion, the upper piston 26 strikes the upper anvil 20*c* provided at the upper end of the shell 20; this is transmitted to the bit as a first impact, with the spline coupling 23 allowing some slight movement of the shell relative to the drill string. Shortly afterwards the lower piston 40 strikes the lower anvil 42, providing a second impact to the bit. Depending on the dimensions of the parts, for example the length of the shell and the closeness of the impacts in time, the pressure waves from the two anvils can arrive at the bit substantially simultaneously, or can be arranged to arrive at very closely spaced time intervals. This provides combined impacts on the bit which are more effective than impacts which would be produced by similar hammers acting at more widely spaced intervals. At the same time portion 40*b* of the lower piston closes the outlet valve by bringing valve member 46 down to close holes 44*a*. Also, the lower piston after separation from the upper piston leaves a small gap between them so that the inlet valve Vi is opened. Both pistons rebound after hitting their anvils due to the dynamic interaction of the steel components and hydraulic pressures. This initiates again the upwards movement of both the pistons.

The effectiveness of this invention requires that the impacts provided by the upper and lower pistons are close in time. Preferably, the upper anvil part 20*c* and the lower anvil member are situated so that the upper piston does not strike the upper anvil part until the lower piston has already completed at least 70% or 80% of its stroke. Also, it is preferable that the lower piston is substantially heavier than the upper piston, e.g. at least 10% heavier and preferably at least 50% heavier.

I claim:

1. An in-the-hole hydraulic hammer drill of the type having an inlet passageway for fluid and connectible to a drill string providing a source of pressurized fluid, and having piston means capable of providing downwardly directed impacts onto anvil means solidly connectible to a drill bit, and having valve means operated automatically by movement of the piston means and/or by fluid pressure to provide a continuous cycle of operation including a continuous series of said impacts, characterized in that:

said piston means includes an upper piston and a lower piston, each capable of impacting respective upper and lower anvil means solid with said drill bit, and in that said valve means includes an inlet valve situated at the junction of the lower end of the upper piston and the upper end of the lower piston and closable by the coming together of the upper and lower pistons, and an outlet valve at the lower end of the lower piston and having a valve member operated by the lower piston to open the outlet valve when the lower piston approaches its upper position and closing the valve when the lower piston approaches a lowermost position;

said valves and pistons being arranged so that when the outlet valve is closed and the inlet valve is open fluid pressure is applied to the lower ends of both pistons and causes these both to rise, and so that when the inlet valve is closed and the outlet valve is open pressure on the bottom of the pistons is relieved and both pistons descend together, and so that the pistons when approaching the tops of their strokes open the outlet valve and close the inlet valve, whereupon the pistons descend together until the upper piston is halted in its movement by impacting the upper anvil means, while the lower piston continues to descend until impacting the lower anvil means, the final stage of downward movement of the lower piston closing the outlet valve and opening the inlet valve to repeat the cycle.

2. A hammer drill according to claim 1, wherein said inlet valve is carried by an upper end of said lower piston, and includes a valve seat closeable by contact with the lower end of the upper piston.

3. A hammer drill according to claim 1, wherein the outlet valve includes a valve member adapted to be lifted by the lower piston to open the outlet valve.

4. A hammer drill according to claim 1, wherein the lower piston is at least 10% heavier than the upper piston.

5. A hammer drill according to claim 1, wherein the lower piston is at least 50% heavier than the upper piston.

6. A hammer drill according to claim 1, wherein each of said upper and lower pistons has an upper portion and a lower portion which is of larger diameter than said upper portion, each said portion being slidable in a corresponding cylinder portion, whereby said pistons can be caused to rise by subjecting both the ends of said pistons to the fluid pressure from the same source.

7. A hammer drill according to claim 1, wherein the upper and lower anvil means are located relative to the pistons so that the upper piston impacts the upper anvil means when the lower piston has already completed at least 70% of its stroke.

8. An in-the-hole hydraulic hammer drill comprising:

an upper housing having means for connection to the lower end of a drill string, said upper housing having an inlet passageway connectible to a fluid passageway in said drill string and communicating with upper cylinder means in said housing, a shell coupled to the lower end of said upper housing by means permitting limited relative axial movement, said shell having a lower end solidly connectible to a drill bit, said shell containing lower cylinder means and having upper anvil means at its upper end;

an upper piston slidable in said upper cylinder means, said upper piston having an upper portion, and having a lower portion of larger diameter than said upper portion, both said portions being slidable in correspondingly sized upper and lower portions of said upper cylinder means, and such that said upper piston can be caused to rise when fluid pressure from the same source is applied to both ends of the upper piston;

a lower piston slidable in said shell, said lower piston having an upper portion situated below the lower portion of the upper piston, and having a lower portion of larger diameter than said upper portion of the lower piston, both said lower piston portions being slidable in correspondingly sized upper and lower portions of said lower cylinder means, and such that said lower piston can be caused to rise when fluid pressure from the same source is applied to both ends of the lower piston;

lower anvil means solid with the drill bit and arranged to be impacted by the lower end of the lower piston;

each of said upper and lower pistons having a central passageway for fluid connectible with said inlet passageway and also connectible with outlet passage means in said drill bit; an inlet valve connecting the passageways of the upper and lower pistons and arranged to be closed when the upper and lower pistons are at their closest proximity and arranged to be opened when said pistons move apart;

an outlet valve connecting the passageway of the lower piston to said outlet passage means of the drill bit and arranged to be closed when the lower piston is in a lowermost position and to be opened when the lower piston is in an upper position;

whereby with said outlet valve closed and the inlet valve open both pistons are subjected to fluid pressure at both ends and are caused to rise, and when both pistons have risen the outlet valve is opened and the inlet valve is closed, so that the upper piston is subjected to pressure on its upper end while pressure on the lower ends of both the pistons is relieved and both pistons are caused to descend, bringing first the upper and then the lower pistons successively into contact with said upper and lower anvil means, thus subjecting the drill bit to successive impacts.

9. A hammer drill according to claim 8, wherein the lower piston is at least 10% heavier than the upper piston.

10. A hammer drill according to claim 8, wherein the lower piston is at least 50% heavier than the upper piston.

11. A hammer drill according to claim 8, wherein the inlet valve comprises a valve seat carried by the upper end of the lower piston and which cooperates with the lower end of the upper piston to close the inlet valve.

* * * * *